United States Patent [19]

Yuasa et al.

[11] Patent Number: 4,604,490

[45] Date of Patent: Aug. 5, 1986

[54] HIGH-DENSITY LIQUID FUEL

[75] Inventors: Hitoshi Yuasa, Yokohama; Mitsuo Matsuno, Kawasaki; Hirosuke Imai, Yokohama, all of Japan

[73] Assignee: Nippon Oil Company Ltd., Japan

[21] Appl. No.: 746,279

[22] Filed: Jun. 19, 1985

[30] Foreign Application Priority Data

Jun. 21, 1984 [JP] Japan ..... 59-127768
Aug. 27, 1984 [JP] Japan ..... 59-177673

[51] Int. Cl.[4] ..... C07C 13/28; C07C 2/50

[52] U.S. Cl. ..... 585/21; 585/14; 585/361; 585/362

[58] Field of Search ..... 585/14, 21, 360, 361, 585/362, 22

[56] References Cited

U.S. PATENT DOCUMENTS 3,144,491 8/1964 O'Connor et al. ..... 585/22
4,177,217 12/1979 Janoski et al. ..... 585/14
4,355,194 10/1982 Norton et al. ..... 585/14
4,394,528 7/1983 Fisher ..... 585/22
4,398,978 8/1983 Burdette et al. ..... 585/360
4,401,837 8/1983 Burdette et al. ..... 585/14
4,507,516 3/1985 Hirooka et al. ..... 585/22

*Primary Examiner*—Andrew H. Metz
*Assistant Examiner*—A. Pal
*Attorney, Agent, or Firm*—Ostrolenk, Faber, Gerb & Soffen

[57] ABSTRACT

The present invention is connected with a high-density liquid fuel for rockets and jet engines which mainly comprises a compound represented by the general formula

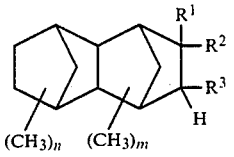

wherein each of m and n is 0 or 1, and each of $R^1$ to $R^3$ is a hydrogen atom or an alkyl group having 1 to 3 carbon atoms, but a sum of $R^1$ to $R^3$ is an integer of 1 to 3.

10 Claims, No Drawings

HIGH-DENSITY LIQUID FUEL

BACKGROUND OF THE INVENTION (1) Field of the Invention

The present invention relates to a high-density liquid hydrocarbon fuel, and more particularly to a high-density and high energy liquid fuel used for jet propulsion of rockets or jet engines.

(2) Description of the Prior Art

In a rocket or a jet engine for a turbo jet, a ram jet, a pulse jet or the like, a high-energy liquid fuel is used. In order to increase the propulsion force of such a jet engine, a fuel having a greater combustion energy per unit weight, i.e., a high-density and high-combustion heat release liquid fuel, is required. The liquid fuel for jet engines is fed to a combustion chamber through a pipe, but since a flying object carrying the jet engine flies at a high altitude and since liquid oxygen is also used, the liquid fuel will be exposed to an extremely low temperature. Therefore, an additional requirement of the liquid fuel for jet engines is that freezing point and viscosity are low even at low temperatures. Further, it is also necessary that the liquid fuel for rockets and jet engines has no unsaturated bond and can be stored stably for a long period of time.

As such liquid fuels for rockets and jet engines, there have been known exo-tetrahydrodicyclopentadiene (JP-10; Japanese Patent Publication No. 20977/1970) which can be prepared by the isomerization of hydrogenated dicyclopentadiene with an acid catalyst, and a compound which can be prepared by hydrogenating a dimer of norbonadiene (RJ-5; U.S. Pat. No. 3,377,398). The aforesaid JP-10 is good in fluidity at low temperatures but is low in density, which disadvantageously lowers the volumetric heat of combustion. On the other hand, the aforesaid RJ-5 has a large heat of combustion, but its fluidity at low temperatures is too poor. Moreover, the RJ-5 has the drawback that it is difficult to synthesize and is expensive.

SUMMARY OF THE INVENTION

An object of the present invention is to provide a high-density and high-energy liquid hydrocarbon fuel which satisfies the above-mentioned requirements necessary for liquid fuels for rockets and jet engines and which can easily be prepared at low cost and on an industrial scale.

That is to say, the present invention is directed to a high-density and high-energy liquid fuel for rockets and jet engines comprising a hydrocarbon compound (II) having no unsaturated bond and represented by the general formula

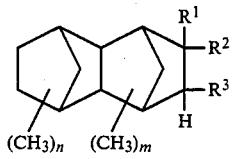

(II)

wherein each of m and n is 0 or 1, and each of $R^1$ to $R^3$ is a hydrogen atom or an alkyl group having 1 to 3 carbon atoms, but the sum of carbon atoms of $R^1$ to $R^3$ is an integer of 1 to 3;

the hydrocarbon compound (II) being prepared by reacting an aliphatic unsaturated hydrocarbon (I) having 3 to 5 carbon atoms and represented by the general formula

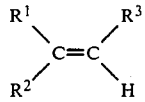

(I)

wherein $R^1$ to $R^3$ are as defined above;

with cyclopentadiene and/or methylcyclopentadiene in accordance with the Diels-Alder reaction to synthesize an adduct of the unsaturated hydrocarbon (I) and cyclopentadiene and/or methylcyclopentadiene in a ratio of 1:2, and then hydrogenating the thus synthesized adduct.

Another object of the present invention is to provide a high-density and high energy liquid fuel for rockets and jet engines comprising a hydrocarbon compound, having no unsaturated bond, which is prepared by reacting commercially available 5-ethylidenenorbornene-2 with cyclopentadiene and/or methylcyclopentadiene in accordance with the Diels-Alder reaction to synthesize an adduct of 5-ethylidenenorbornene-2 and cyclopentadiene and/or methylcyclopentadiene in a ratio of 1:1, i.e., a 1:1 adduct, separating the adduct, and hydrogenating carbon-carbon double bonds in the adduct.

The Diels-Alder reaction of the aliphatic unsaturated hydrocarbon (I) having 3 to 5 carbon atoms with cyclopentadiene and/or methylcyclopentadiene which is utilized in the present invention makes progress in the following sequence to prepare the adduct (IV) in a ratio of 1:2, i.e., the 1:2 adduct (IV):

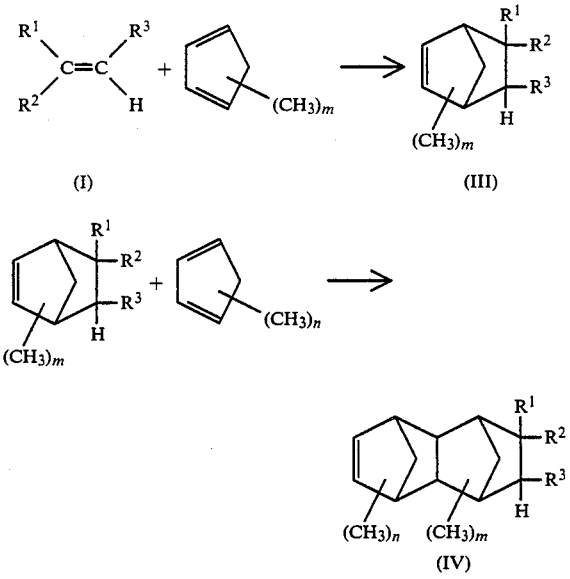

wherein each of m and n is 0 or 1, and each of $R^1$ to $R^3$ is an alkyl group having 1 to 3 carbon atoms, but the sum of the carbon atoms of the $R^1$ to $R^3$ is an integer of 1 to 3.

That is to say, the aliphatic unsaturated hydrocarbon (I) having 3 to 5 carbon atoms is reacted with cyclopentadiene and/or methylcyclopentadiene in accordance with the Diels-Alder reaction at first in order to prepare the adduct (III) in a ratio of 1:1, i.e., the 1:1 adduct (III). After that, the adduct (III) thus prepared is further subjected to the Diels-Alder reaction with one molecule of cyclopentadiene or methylcyclopentadiene in order to prepare the 1:2 adduct (IV). The above-mentioned reactions may be carried out without separating the 1:1 adduct (III) from the reaction mixture, but the other manner may be possible which comprises first synthesizing the 1:1 adduct (III) of the unsaturated hydrocarbon (I) having 3 to 5 carbon atoms and cyclopentadiene and/or methylcyclopentadiene, separating the thus prepared adduct (III) therefrom, and carrying out the Diels-Alder reaction between the adduct (III) and one molecule of cyclopentadiene or methylcyclopentadiene. The Diels-Alder reaction of the unsaturated hydrocarbon (I) having 3 to 5 carbon atoms and cyclopentadiene and/or methylcyclopentadiene is a thermal reaction and does not need any catalyst. The present invention employs the aliphatic unsaturated hydrocarbon having 3 to 5 carbon atoms and represented by the following general formula:

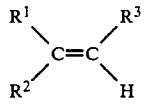

(I)

wherein each of $R^1$ to $R^3$ is a hydrogen atom or an alkyl group having 1 to 3 carbon atoms, but the sum of the carbon atoms in the $R^1$ to $R^3$ is an integer of 1 to 3.

Concrete examples of such unsaturated hydrocarbons include propylene, 1-butene, 2-butene, isobutylene, 1-pentene, 2-pentene, 2-methyl-1-butene, 3-methyl-1-butene and 2-methyl-2-butene. Cyclopentadiene or methylcyclopentadiene which is another reaction material may be added thereto as a monomer, but alternatively there may be used, as the raw material, a dimer such as dicyclopentadiene, methyldicyclopentadiene or dimethyldicyclopentadiene which can produce cyclopentadiene and/or methylcyclopentadiene by thermal decomposition under the reaction conditions.

In the Diels-Alder reaction of the aliphatic unsaturated hydrocarbon (I) having 3 to 5 carbon atoms with cyclopentadiene and/or methylcyclopentadiene, the 1:2 adduct (IV) may be formed without separating the 1:1 adduct (III) from the reaction mixture. However, the 1:1 adduct (III) of the aliphatic unsaturated hydrocarbon (I) and cyclopentadiene and/or methylcyclopentadiene may first be synthesized, and it is separated out intendedly. Then, the separated adduct (III) may further be reacted with cyclopentadiene or methylcyclopentadiene in accordance with the Diels-Alder reaction in order to prepare the 1:2 adduct (IV).

In the latter method which comprises synthesizing the 1:1 adduct (III), separating it out and reacting it with cyclopentadiene or methycyclopentadiene to prepare the 1:2 adduct (IV), the molar ratio of the unsaturated hydrocarbon (I) having 3 to 5 carbon atoms to cyclopentadiene and/or methylcyclopentadiene or a dimer thereof, and the molar ratio of the 1:1 adduct (III) to cyclopentadiene and/or methylcyclopentadiene or a dimer thereof are within the range of 1:0.001 to 1:10, preferably 1:0.01 to 1:3. In the former method for synthesizing the 1:2 adduct (IV) without separating the 1:1 adduct (III) from the reaction system, the molar ratio of the aliphatic unsaturated hydrocarbon (I) having 3 to 5 carbon atoms to cyclopentadiene and/or methylcyclopentadiene or a dimer thereof is within the range of 1:0.5 to 1:10, preferably 1:1 to 1:5.

In any Diels-Alder reaction mentioned above, the reaction temperature is within the range of 50° to 250° C., preferably 80° to 200° C. in the case that cyclopentadiene or methylcyclopentadiene is used as the raw material, and is within the range of 100° to 250° C., preferably 120° to 200° C. in the case that dicyclopentadiene, methyldicyclopentadiene or dimethyldicyclopentadiene is used as the raw material.

The reaction time is, in any Diels-Alder reaction, within the range of 10 minutes to 40 hours, preferably 30 minutes to 30 hours, depending upon the reaction temperature just described.

In accomplishing these Diels-Alder reactions, it is preferred that polymerization inhibitors such as hydroquinone, tert-butylcatechol and p-phenylenediamine may be added thereto to inhibit the production of polymers.

Further, these reactions may be carried out in a solvent, for example, a lower alcohol such as methanol or ethanol, or a hydrocarbon such as toluene or cyclohexane which will not prevent the reactions. For these Diels-Alder reactions, any reaction manner of a batch process, a semi-batch process and a continuous process can be employed.

In the Diels-Alder reaction of the aliphatic unsaturated hydrocarbon (I) having 3 to 5 carbon atoms with the cyclopentadiene and/or methylcyclopentadiene, the above-mentioned 1:1 adduct (III) and 1:2 adduct (IV) are produced, but oligomers such as a trimer, a tetramer and a pentamer of cyclopentadiene or methylcyclopentadiene are produced together as by-products, and polymers in which cyclopentadiene or methylcyclopentadiene is added to the 1:2 adduct (IV) are also secondarily produced. The hydrogenated compounds of these by-products have high melting points and are poor in fluidity at low temperatures. Consequently, when the liquid fuel for rockets and jet engines is contaminated with such by-products, its performance will degrade, and in some cases its utilization will become impossible. Therefore, in order to synthesize the high-density and high evergy liquid fuel which is good in fluidity at low temperatures according to the present invention, it is necessary to separate the 1:2 adduct (IV) from the Diels-Alder reaction product mixture which is prepared under the above-mentioned reaction conditions and to purify it by means of distillation or the like.

The 1:2 adduct (IV) which has been synthesized from the aliphatic unsaturated hydrocarbon (I) having 3 to 5 carbon atoms and cyclopentadiene and/or methylcyclopentadiene, separated out and purified by the above-mentioned procedure is chemically unstable because of having a reactive double bond, and thus it cannot be stored stably for a long period of time. In order to adapt the adduct to the liquid fuel for rockets and jet engines, it is required to be converted into a saturated hydrocarbon by hydrogenation. This treatment for the 1:2 adduct can be carried out under the same conditions as in the case of usual hydrogenations for unsaturated hydrocarbons. That is to say, the hydrogenation can easily be accomplished at a temperature of 20° to 225° C. under a hydrogen pressure of 1 to 200 $Kg/cm^2$ by the use of a noble metal catalyst such as platinum, palladium, rhodium or ruthenium, or a hydrogenation catalyst such as Raney nickel. Further, the hydrogenation can be carried out under non-solvent conditions, but may be susceptible also in a solvent such as a hydrocarbon, an alcohol, an ester or an ether. After the hydrogenation of the 1:2 adduct (IV) has been completed, the product (II) is separated from the mixture of the used solvent, unreacted materials, decomposition products slightly formed in some cases and the catalyst residue.

Next, another aspect of the present invention will be described.

The Diels-Alder reaction of 5-ethylidenenorbornene-2 with cyclopentadiene or methylcyclopentadiene makes progress mainly in the following order to prepare an adduct (V) in a ratio of 1:1, i.e., a 1:1 adduct (V):

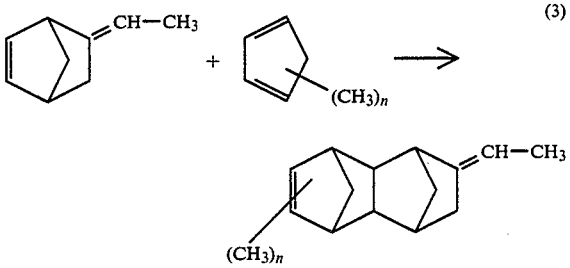

(3)

(V)
(n = 0 or 1)

Under other reaction conditions, another 1:1 adduct (VI) may partially be produced in a small amount, for example, in an amount of 5 mol % or less in accordance with the following reaction:

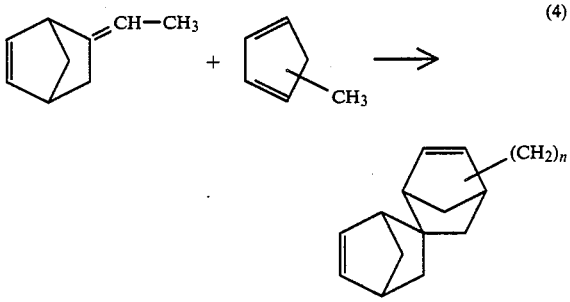

(4)

(VI)
(n = 0 or 1)

Under the usual conditions of the Diels-Alder reaction, the reaction rate of formula (4) is much slower than that of formula (3). Therefore, the product of the Diels-Alder reaction of 5-ethylidenenorbornene-2 with cyclopentadiene or methylcyclopentadiene mainly comprises the compound represented by the structural formula (V).

The Diels-Alder reaction of 5-ethylidenenorbornene-2 and cyclopentadiene or methylcyclopentadiene is a thermal reaction and does not need any catalyst. Cyclopentadiene and/or methylcyclopentadiene which is a reaction raw material may be added to the reaction system in the form of a monomer or dimer such as dicyclopentadiene, methyldicyclopentadiene or dimethyldicyclopentadiene which can produce cyclopentadiene or methylcyclopentadiene by thermal decomposition under the reaction conditions.

The molar ratio of 5-ethylidenenorbornene-2 to cyclopentadiene and/or methylcyclopentadiene is within the range of 1:0.001 to 1:10, preferably 1:0.01 to 1:2.

The reaction temperature is within the range of 50° to 250° C., preferably 80° to 200° C. in the case that cyclopentadiene or methylcyclopentadiene is used as the raw material, and is within the range of 100° to 250° C., preferably 120° to 200° C. in the case that dicyclopentadiene, methyldicyclopentadiene or dimethyldicyclopentadiene is used as the raw material.

The reaction time is within the range of 10 minutes to 20 hours, preferably 30 minutes to 5 hours, depending upon the reaction temperature just described.

In accomplishing this Diels-Alder reaction, it is preferred that the polymerization inhibitors such as hydroquinone, tert-butylcatechol or p-phenylnenediamine may be added thereto to inhibit the production of polymers.

Further, this reaction may be carried out in a solvent, for example, a lower alcohol such as methanol or ethanol, or a hydrocarbon such as toluene or cyclohexane which will not prevent the reactions. For the Diels-Alder reaction, any reaction manner of a batch process, a semi-batch process and a continuous process can be employed.

In the Diels-Alder reaction of 5-ethylidenenorbornene-2 with the cyclopentadiene or methylcyclopentadiene, the above-mentioned 1:1 adduct (mainly the formula (V)) is produced, but oligomers such as a trimer, a tetramer and a pentamer of cyclopentadiene or methylcyclopentadiene are also produced together as by-products, and polymers in which cyclopentadiene or methylcyclopentadiene is added to the 1:1 adduct (mainly the formula (V)) are further secondarily produced.

The hydrogenated compounds of these by-products have high melting points and are poor in fluidity at low temperatures, and thus when the liquid fuel for rockets and jet engines is contaminated with such by-products, its performance will degrade and in some cases, its utilization will become impossible. Therefore, in order to synthesize the high-density and high-energy liquid fuel which is good in fluidity at low temperatures according to the present invention, it is necessary to separate the 1:1 adduct from the Diels-Alder reaction products which are prepared under the above-mentioned reaction conditions and to purify it by means of distillation or the like.

The 1:1 (V) adduct which has been synthesized from 5-ethylidenenorbornene-2 and cyclopentadiene or methylcyclopentadiene and which has been separated out and purified by the above-mentioned procedure is chemically unstable because of having two carbon-carbon double bonds, and thus it cannot be stored stably for a long period of time. In order to adapt the adduct to the liquid fuel for rockets and jet engines, it is required to be converted into a saturated hydrocarbon by hydrogenation. This treatment for the 1:1 adduct (V) can be carried out under the same conditions as in the case of usual hydrogenations for unsaturated hydrocarbons. Further, the hydrogenation reaction can be carried out under non-solvent conditions, but may be susceptible also in a solvent such as a hydrocarbon, an alcohol, an ester or an ether. After the hydrogenation of the 1:1 adduct (V) has been completed, the tetrahydro product of the 1:1 adduct (V) is separated from the mixture of the used solvent, unreacted materials, decomposition products slightly formed in some cases and the catalyst residue.

The hydrogenated compound (II) represented by the general formula

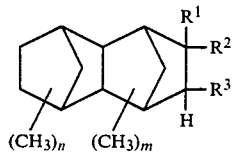

(II)

wherein each of m and n is 0 or 1, and each of $R^1$ to $R^3$ is an alkyl group having 1 to 3 carbon atoms, but the sum of carbon atoms in $R^1$ to $R^3$ is an integer of 1 to 3; can be prepared by hydrogenating the 1:2 adduct (IV) of the aliphatic unsaturated hydrocarbon having 3 to 5 carbon atoms with cyclopentadiene and/or methylcyclopentadiene, and the hydrogenated product (II) has a high density and a high heat of combustion. Additionally, its freezing point is −50° C. or less, and thus its fluidity at low temperatures is also excellant. Moreover, since the fuel of the present invention can be synthesized using, as the raw materials, a commercially easily available unsaturated hydrocarbon (I) such as propylene, butene or pentene and cyclopentadiene, methylcyclopentadiene, its co-dimer or dimer in accordance with the Diels-Alder reaction in which any catalyst is not required, it can be synthesized advantageously at lower costs than conventional liquid fuels for rockets and jet engines. In addition thereto, the liquid fuel according to the present invention has many favorable characteristics such as chemical stability, long-term storage, non-corrosive against metals.

The hydrogenated product (II) of the 1:2 adduct (IV) of the aliphatic unsaturated hydrocarbon having 3 to 5 carbon atoms with cyclopentadiene and/or methylcyclopentadiene can be used alone as the fuel for rockets and jet engines and may also be mixed with a known liquid fuel when used.

Further, the hydrogenated product of the 1:1 adduct which is synthesized from 5-ethylidenenorbornene-2 and cyclopentadiene and/or methylcyclopentadiene is the liquid fuel for rockets and jet engines having as high a density as 0.984 (15° C./4° C.) and as high net heat of combustion as 10,000 cal/g or more, and its freezing point is −50° C. or less and thus its fluidity properties at low temperatures are excellent. Moreover, since the fuel of the present invention can be synthesized using, as the raw materials, commercially easily available 5-ethylidenenorbornene-2 and cyclopentadiene and/or methylcyclopentadiene in accordance with the Diels-Alder reaction in which a catalyst is not required, it can be synthesized advantageously at lower costs than conventional liquid fuels for rockets and jet engines. In addition thereto, the liquid fuel according to the present invention is chemically unchangeable, is stable during a long-term storage, and is non-corrosive against metals conveniently.

The hydrogenated product of the 1:1 adduct (V) of 5-ethylidenenorbornene-2 with cyclopentadiene and/or methylcyclopentadiene can be used alone as the fuel for rockets and jet engines and may also be mixed with a known liquid fuel when used. The known fuels which can be mixed with the liquid fuels of the present invention include exotetrahydrodicyclopentadiene, the hydrogenated product of dimers of norbornadiene known as RJ-5, the hydrogenated products of trimers of cyclopentadiene and methylcyclopentadiene (Japanese Patent Provisional Publication No. 59820/1982), di- or tricyclohexyl alkane (U.K. Pat. No. 977322), mono- or dicyclohexyl-dicyclic alkane (U.K. Pat. No. 977323), naphthene hydrocarbons and isoparaffin hydrocarbons (Japanese Patent Provisional Publication No. 139186/1982).

DESCRIPTION OF THE PREFERRED EMBODIMENTS

The present invention will be described in detail in reference to examples. It is to be noted that these examples illustrate the present invention but are not intended to limit the scope thereof.

EXAMPLE 1

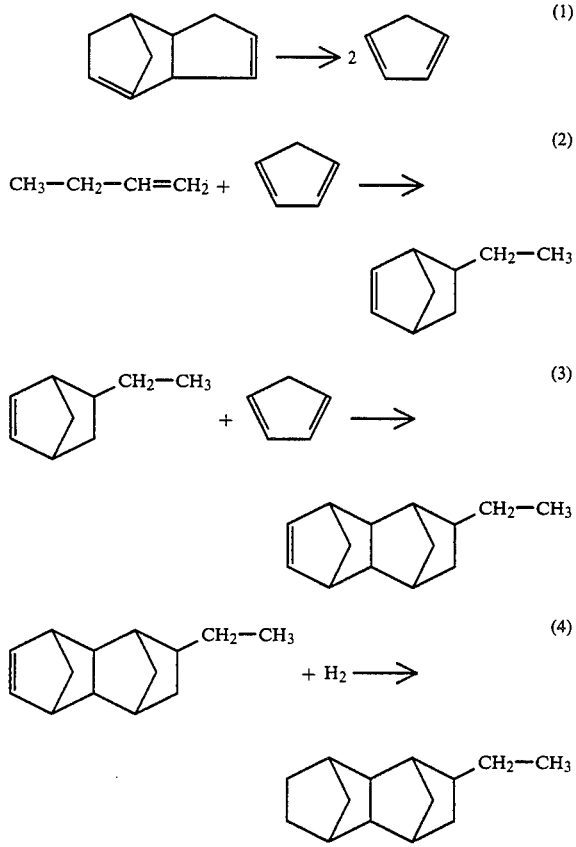

In a 1000-ml stainless steel magnetic stirrer type autoclave in which the atmosphere had been replaced with nitrogen, 162 g of 1-butene and 198 g of dicyclopentadiene were placed, and the reaction was carried out at 170° C. for 25 hours. After the completion of the reaction, unreacted 1-butene was collected by a trap in a bath including dry ice and methanol. Afterward, the resultant reaction liquid was subjected to a vacuum distillation in order to recover 52 g of unreacted dicyclopentadiene and to obtain 97 g of 5-ethyl-2-norbornene and 8 g of a fraction of a boiling point of 87° C./1 mmHg. In this case, the amount of recovered 1-butene was 112 g. Therefore, in this Diels-Alder reaction, the conversion of 1-butene was 31% and the selectivity of 5-ethyl-2-norbornene to reacted 1-butene was 89%.

This 5-ethyl-2-norbornene was reacted with dicyclopentadiene in the same manner as mentioned above in order to synthesize a 2:1 adduct of cyclopentadiene and 1-butene as follows: At 165° C., 94 g of 5-ethyl-2-norbornene were reacted with 119 g of dicyclopentadiene for 30 hours, and the resultant reaction liquid was then subjected to a vacuum distillation treatment, so that 18 g of unreacted 5-ethyl-2-norbornene and 36 g of dicyclopentadiene were recovered and 84 g of a fraction were obtained at a boiling point of 87° C./1 mmHg. From measurement by a mass spectrometer, it was found that a molecular weight of this fraction was 188. Further, according to infrared analysis (IR) of the fraction, the characteristic absorption of olefins appeared at 3020 $cm^{-1}$ and 1672 $cm^{-1}$. According to $^1H$-NMR analysis, the absorption belonging to hydrogen atoms bonded to a carbon-carbon double bond appeared at δ6.0 ppm, and the absorptions belonging to hydrogen atoms not bonded to the carbon-carbon double bond in δ0.8 to 3.0 ppm, but the area ratio of these two absorptions was 2:18. The results clearly indicated that the obtained product was the 2:1 adduct of cyclopentadiene and 1-butene. Accordingly, in the Diels-Alder reaction, the conversion of 5-ethyl-2-norbornene was 81%, and the selectivity of the 2:1 adduct of cyclopentadiene and 1-butene was 72%. In the above-mentioned reaction of 1-butene with dicyclopentadiene, the fraction having a boiling point of 87° C./1 mmHg was obtained in a small amount in addition to 5-ethyl-2-norbornene, and it was found that this fraction was identified as the 2:1 adduct of cyclopentadiene and 1-butene whose characteristics such as molecular weight, IR spectrum and $^1H$-NMR spectrum were completely identical to those of the Diels-Alder product of 5-ethyl-2-norbornene and dicyclopentadiene.

The hydrogenation of the 2:1 adduct was carried out as follows: In a 500-ml stainless steel autoclave, there were placed 95 g of the 2:1 adduct synthesized from cyclopentadiene and 1-butene in the above-mentioned manner and 1.2 g of a palladium-carbon catalyst carrying 5% of palladium. Then, the reaction was performed at the temperature of 28° C., maintaining hydrogen pressure at 7 $Kg/cm^2$. When the reaction time of 10 hours had elapsed, the feed of hydrogen was stopped, and it was confirmed that hydrogen was not absorbed thereby any more, and thus the reaction was brought to an end. The resultant reaction liquid was taken out from the autoclave, the used catalyst was filtered off, and by vacuum distillation 90 g of the hydrogenated product of the 2:1 adduct of cyclopentadiene and 1-butene having the boiling point of 71° C./0.5 mmHg were obtained.

The thus prepared hydrogenated product had a freezing point of −50° C. or less, a specific gravity of 0.985 (15° C./4° C.) and a net heat of combustion of 10,055 cal/g.

EXAMPLE 2

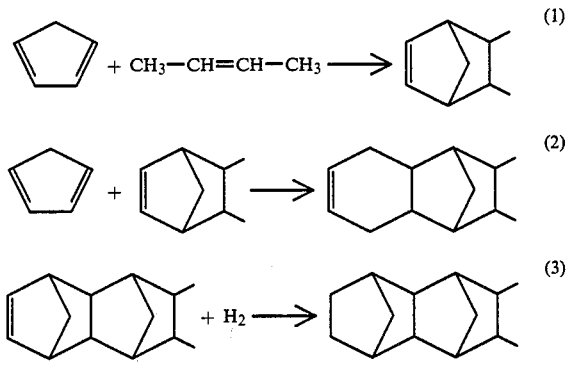

In a 2000-ml stainless steel autoclave in which the atmosphere had been replaced with nitrogen, 330 g of cyclopentadiene and 280 g of 2-butene were charged, and heating was gradually carried out under stirring over a period of 1.8 hours so that its temperature might become 25° to 120° C. Afterward, the reaction was performed at 120° C. for 8 hours. Then, unreacted 2-butene was purged, and the resultant reaction liquid was subjected to atmospheric distillation in order to remove residual cyclopentadiene. Afterward, a vacuum distillation treatment was carried out to obtain 122 g of 5,6-dimethyl-2-norbornene.

The Diels-Alder reaction of 5,6-dimethyl-2-norbornene with cyclopentadiene was accomplished in the same manner as described above. That is to say, 120 g of 5,6-dimethyl-2-norbornene and 190 g of cyclopentadiene were placed in the autoclave and were heated over 2 hours so that its interior temperature might become 25° to 120° C., and the reaction was continued at 120° C. for 7 hours. The resultant reaction liquid was subjected to atmospheric distillation in order to remove unreacted cyclopentadiene, and a vacuum distillation was then carried out to prepare 82 g of a fraction of the boiling point of 106° C./3 mmHg. According to a gas chromatography analysis, it was confirmed that the thus prepared fraction contained 99.3% of a 1:1 adduct of 5,6-dimethyl-2-norbornene and cyclopentadiene, i.e., a 2:1 adduct of cyclopentadiene and 2-butene.

Next, in a 500-ml stainless steel autoclave in which the atmosphere had been replaced with nitrogen, there were placed 80 g of the aforesaid 2:1 adduct of cyclopentadiene and 2-butene, 100 ml of toluene and 0.7 g of a Raney nickel catalyst. Under stirring the reaction temperature was controlled at 45° C., and the pressure of hydrogen was kept at 15 $Kg/cm^2$ for 7 hours. Then, the feed of hydrogen was stopped, and from the observation of a pressure drop, it was found that no hydrogen was consumed any more. So, the resultant reaction liquid was taken out therefrom and the used catalyst was filtered off under a nitrogen flow, followed by vacuum distilation. As a result, 80 g of a hydrogenated product of the 2:1 adduct were obtained at 114° C./4 mmHg which had a freezing point of −50° C. or less, a specific gravity of 0.979 (15° C./4° C.) and a net heat of combustion of 10,040 cal/g.

EXAMPLE 3

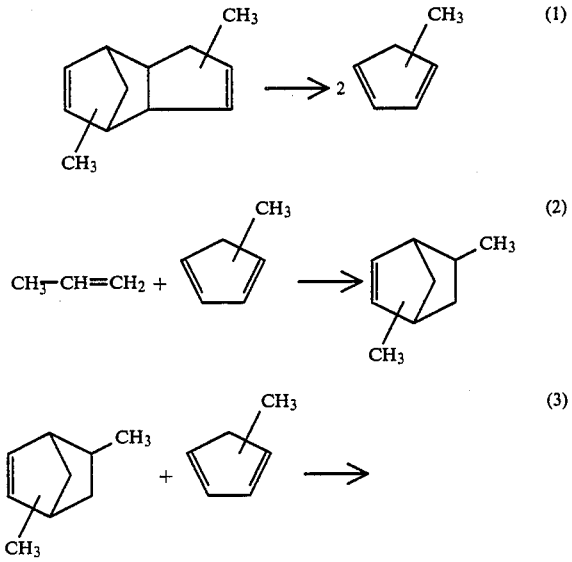

-continued

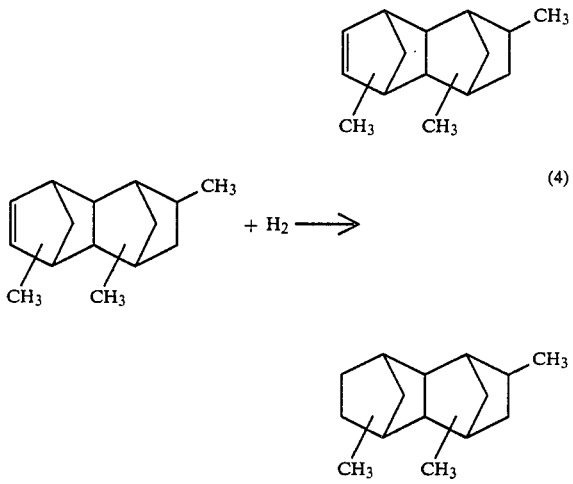

(4)

In the same manner as in Example 1, a 2:1 adduct of methylcyclopentadiene and propylene was synthesized using propylene and dimethyldicyclopentadiene as raw materials, as follows:

At 170° C., 156 g of propylene were reacted with 243 g of dimethyldicyclopentadiene for 20 hours, and by vacuum distillation 93 g of dimethylnorbornene were obtained. Then, 91 g of the thus prepared dimethylnorbornene were reacted with 135 g of dimethyldicyclopentadiene at 165° C. for 20 hours, and for the resultant reaction liquid, vacuum distillation was carried out to obtain 73 g of a 1:1 adduct of dimethylnorbornene and methylcyclopentadiene, i.e., a 2:1 adduct of methylcyclopentadiene and propylene at a boiling point of 97° C./2 mmHg.

The hydrogenation of this adduct was also carried out in the same manner as in Example 1. That is to say, while a hydrogen pressure was maintained at 10 Kg/cm$^2$, 70 g of the 2:1 adduct of methylcyclopentadiene and propylene were hydrogenated at 50° C. for 6 hours, using 1.1 g of a platinum-carbon catalyst carrying 5% of platinum. After the reaction, vacuum distillation was carried out, and 69 g of a hydrogenated product (73° C./0.5 mmHg; purity 99.1%) of the 2:1 adduct of methylcyclopentadiene and propylene were obtained.

This hydrogenated product had a freezing point of −50° C. or less, a specific gravity of 0.976 (15° C./4° C.) and a net heat of combustion of 10,040 cal/g.

EXAMPLE 4

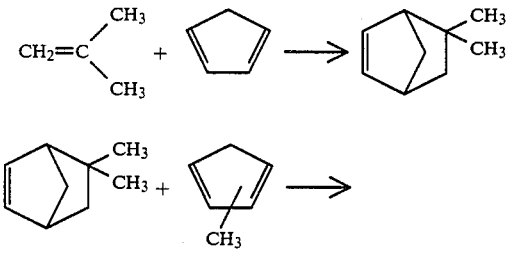

(1)

(2)

-continued

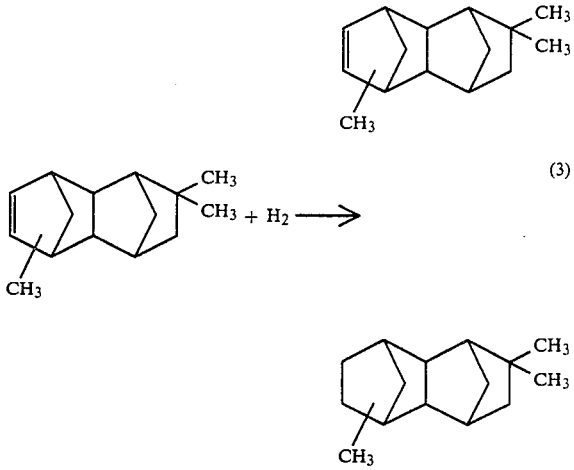

(3)

In the same manner as in Example 2, a Diels-Alder reaction was carried out on isobutylene and cyclopentadiene in order to synthesize 5,5-dimethyl-2-norbornene, and the latter was then reacted with methylcyclopentadiene to produce a 1:1:1 adduct of methylcyclopentadiene, cyclopentadiene and isobutylene. That is to say, 225 g of isobutylene and 260 g of cyclopentadiene were placed in a 1000-ml autoclave, and heating was gradually accomplished so that its temperature might become 25° to 120° C. and a reaction was performed at 120° C. for 8 hours, so that 118 g of 5,5-dimethyl-2-norbornene were obtained. Then, 115 g of the latter compound were similarly reacted with 201 g of methylcyclopentadiene at 120° C. for 10 hours. Then, 97 g of a fraction having a boiling point 97° C./1 mmHg were obtained. According to the measurement by a mass spectrometer, it was found that a molecular weight of the fraction was 202. Further, IR analysis indicated that characteristic absorptions of olefins appeared at 3020 cm$^{-1}$ and 1670 cm$^{-1}$. From these results, it was elucidated that the fraction was the 1:1 adduct of 5,5-dimethyl-2-norbornene and methylcyclopentadiene, i.e., the 1:1:1 adduct of methylcyclopentadiene, cyclopentadiene and isobutylene.

The hydrogenation of this adduct was also carried out in the same manner as in Example 2. That is to say, there were used 91 g of the 1:1:1 adduct of methylcyclopentadiene, cyclopentadiene and isobutylene, 0.8 g of palladium black and 100 g of hexane, and hydrogen was successively added to their mixture while a hydrogen pressure was maintained at 5 Kg/cm$^2$. When a reaction time of 15 hours had elapsed, the reaction was over. The resultant reaction liquid was taken out from the autoclave, and the used catalyst was filtered off. Then 87 g of a hydrogenated product of the 1:1:1 adduct of methylcyclopentadiene, cyclopentadiene and isobutylene were obtained.

This hydrogenated product had a freezing point of −50° C. or less, a specific gravity of 0.971 (15° C./4° C.) and a net heat of combustion of 10,050 cal/g.

EXAMPLE 5

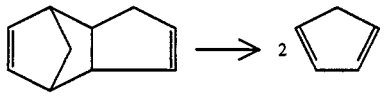

(1)

-continued (2)

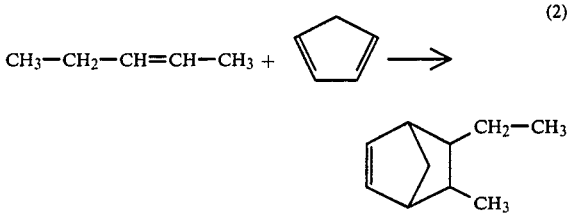

(3)

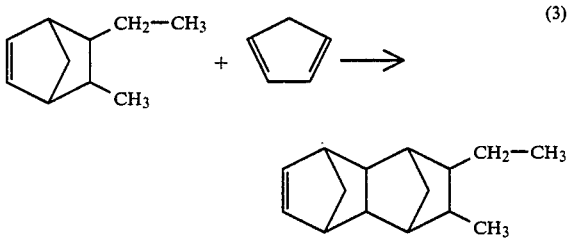

(4)

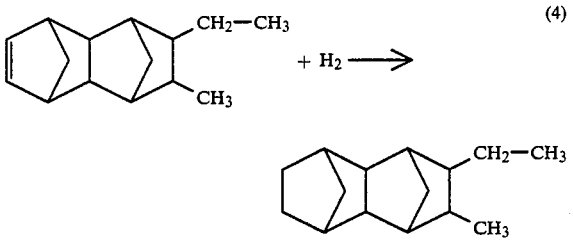

In the same manner as in Example 1, a 2:1 adduct of cyclopentadiene and 2-pentene was synthesized.

In a 2000-ml stainless steel autoclave in which the atmosphere had been replaced with nitrogen, 528 g of dicyclopendadiene and 135 g of 2-pentene were placed, and a reaction was carried out at 180° C. for 15 hours. After the completion of the reaction, by vacuum distillation 91 g of 5-ethyl-6-methyl-2-norbornene and 27 g of the 2:1 adduct (boiling point 96° C./1 mmHg; purity 98.3%) of cyclopentadiene and 2-pentene were obtained.

In a 500-ml stainless steel autoclave, 27 g of this 2:1 adduct, 0.8 g of a rhodium-carbon catalyst carrying 5% of rhodium and 80 g of heptane were placed, and a reaction was performed at 70° C. for 3 hours, while a hydrogen pressure therein was maintained at 10 Kg/cm$^2$. After the completion of the reaction, the used catalyst was filtered off. The resultant reaction liquid was then subjected to a vacuum distillation and 27 g of a hydrogenated product (boiling point 85° C./0.3 mmHg; purity 97.5%) of the 2:1 adduct of cyclopentadiene and 2-pentene were obtained.

This hydrogenated product had a freezing point of −50° C. or less, a specific gravity of 0.963 (15° C./4° C.) and a net heat of combustion of 10,055 cal/g.

EXAMPLE 6

(1)

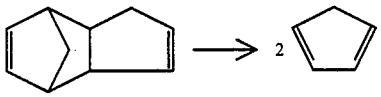

(2)

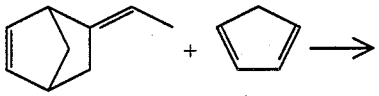

-continued (3)

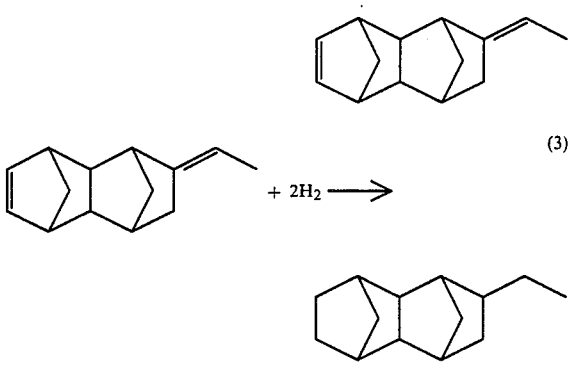

In 2000-ml stainless steel autoclave in which the atmosphere had been replaced with nitrogen, 362 g of 5-ethylidenenorbornene-2 and 225 g of dicyclopentadiene were placed, and the reaction was carried out under stirring at 157° C. for 31 hours. After the completion of the reaction, vacuum distillation was accomplished for the resultant reaction liquid, then 88 g of unreacted 5-ethylidenenorbornene-2, to obtain 407 g of a fraction of a boiling point of 86° C./1 mmHg were recovered. This fraction was analyzed by the use of a gas chromatography, whereby it was elucidated that its purity was 99.4%. Further, according to the measurement by a mass spectrometer, its molecular weight was 186. Furthermore, from an IR analysis of this franction, it was found that characteristic absorptions of olefins appeared at 3020 cm$^{-1}$ and 1670 cm$^{-1}$. According to $^1$H-NMR analysis, absorptions belonging to hydrogen atoms bonded to a carbon-carbon double bond appeared in δ5 to 6.5 ppm, and absorptions belonging to hydrogen atoms not bonded to the carbon-carbon double bond appeared in δ1 to 3.5 ppm, but an area ratio of these peaks was 3:15. The results clearly indicated that the obtained product was the 1:1 adduct of 5-ethylidenenorbornene-2 and cyclopentadiene. Accordingly, in the Diels-Alder reaction, the conversion of 5-ethylidenenorbornene-2 was 76%, and the yield of the 1:1 adduct of 5-ethylidenenorbornene and cyclopentadiene was 73%.

The hydrogenation of the 1:1 adduct was carried out as follows: In a 2000-ml stainless steel autoclave, there were placed 398 g of the 1:1 adduct which was synthesized in the above-mentioned manner and 3.5 g of a palladium-carbon catalyst carrying 5% of palladium. Under stirring hydrogenation was carried out at a temperature of 30° C., maintaining a hydrogen pressure at 8 Kg/cm$^2$. When a reaction time of 20 hours had elapsed, the feed of hydrogen was stopped, and at this time, it was confirmed that hydrogen was not absorbed thereby any more, and thus the reaction was brought to an end. The resultant reaction liquid was taken out from the autoclave, and the used catalyst was filtered off, followed by vacuum distillation. 405 g of the hydrogenated product (66° C./0.3 mmHg) of the 1:1 adduct of 5-ethylidenenorbornene-2 and cyclopentadiene were obtained.

The thus prepared hydrogenated product had a freezing point of −50° C. or less, a specific gravity (15° C./4° C.) of 0.984 and a net heat of combustion of 10,050 cal/g.

EXAMPLE 7

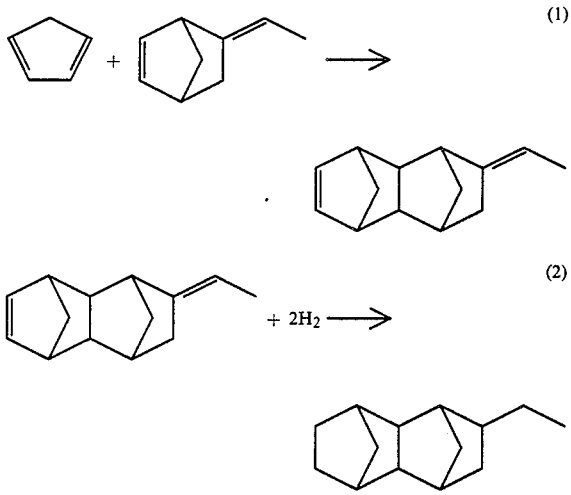

In a 2000-ml stainless steel autoclave in which the atmosphere had been replaced with nitrogen, 600 g of 5-ethylidenenorbornene-2 and 330 g of cyclopentadiene were placed, and heating was gradually carried out under stirring over a period of 2 hours so that its temperature might become 25° to 120° C. The reaction was performed at 120° C. for 5 hours. After the completion of the reaction, the resultant reaction liquid was subjected to an atmospheric distillation treatment in order to remove unreacted cyclopentadiene. Then, vacuum distillation was carried out, and 119 g of a fraction of a boiling point 86° C./1 mmHg were obtained. According to a gas chromatography analysis, it was confirmed that the thus prepared fraction contained 99.1% of a 1:1 adduct of 5-ethylidenenorbornene-2 and cyclopentadiene.

Next, in a 1000-ml stainless steel autoclave in which the atmosphere had been replaced with nitrogen, 100 g of the above-mentioned 1:1 adduct and 0.5 g of a Raney nickel catalyst were placed. Then under stirring hydrogen was continuously added thereto to keep 10 Kg/cm$^2$ at 40° C. When a reaction time of 10 hours had elapsed, the feed of hydrogen was stopped and the observation of a pressure drop was made, whereby it was found that no hydrogen was consumed any more. Then, the resultant reaction liquid was taken out therefrom and the used catalyst was filtered off under a nitrogen flow, followed by vacuum distillation. As a result, 95 g of a hydrogenated product (boiling point 66° C./0.3 mmHg) of the 1:1 adduct were obtained. This hydrogenated product of the 1:1 adduct had a freezing point of −50° C. or less, a specific gravity of 0.984 (15° C./4° C.) and a net heat of combustion of 10,040 cal/g.

EXAMPLE 8

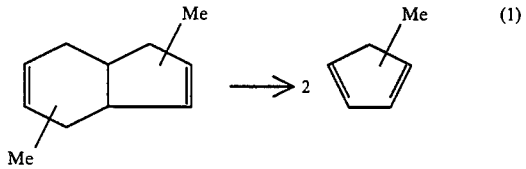

-continued

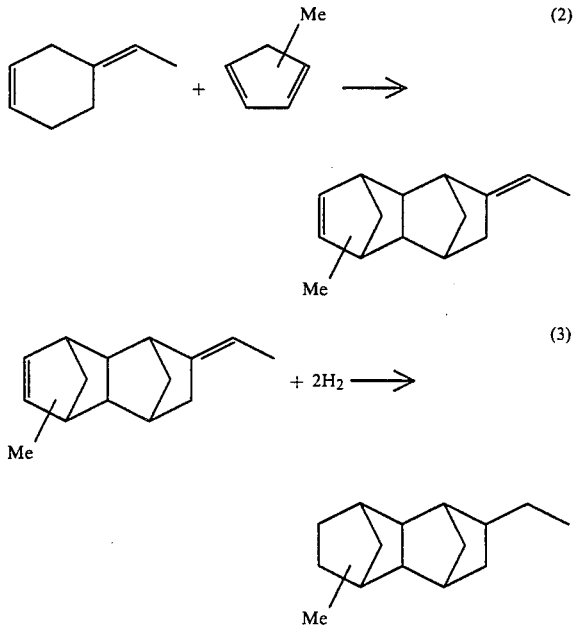

In a 2000-ml stainless steel autoclave in which the atmosphere had been replaced with nitrogen, 600 g of 5-ethylidenenorbornene-2 and 480 g of dimethyldicylopentadiene were placed, and a reaction was carried out at 170° C. for 10 hours. After the completion of the reaction, the resultant reaction liquid was subjected to a vacuum distillation, and 365 g of a 1:1 adduct (boiling point 87° C./0.7 mmHg; purity 95.4%) of 5-ethylidenenorbornene-2 and methylcyclopentadiene were obtained.

Next, in a 1000-ml stainless steel autoclave, there were placed 300 g of the 1:1 adduct of 5-ethylidenenorbornene-2 and methylcyclopentadiene and 3.5 g of a palladium-carbon catalyst carrying 5% of palladium, and a reaction was performed at 50° C. for 15 hours, keeping the hydrogen pressure at 10 Kg/cm$^2$. After the completion of the reaction, the used catalyst was filtered off. The resultant reaction liquid was subjected to a vacuum distillation. Then 279 g of a hydrogenated product (boiling point 78° C./0.3 mmHg; purity 95.6%) of the 1:1 adduct of 5-ethylidenenorbornene-2 and methylcyclopentadiene were obtained.

This hydrogenated product had a freezing point of −50° C. or less, a specific gravity of 0.975 (15° C./4° C.) and a net heat of combustion of 10,030 cal/g.

What is claimed is:

1. A high-density liquid fuel consisting essentially of a compound of the formula

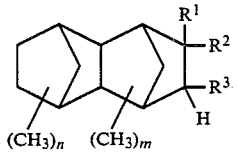

wherein each of m and n is 0 or 1, and each of $R^1$, $R^2$ and $R^3$ is a hydrogen atom or an alkyl group having 1 to 3 carbon atoms, the sum of carbon atoms in $R^1$, $R^2$ and $R^3$ being an integer of 1 to 3;

prepared by reacting an aliphatic unsaturated hydrocarbon having 3 to 5 carbon atoms of the formula

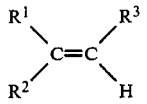

wherein $R^1$, $R^2$ and $R^3$ are as defined above, with cyclopentadiene, methylcyclopentadiene and mixtures thereof in accordance with the Diels-Alder reaction to synthesize a 1:2 adduct of the unsaturated hydrocarbon and the pentadiene, and then hydrogenating the thus synthesized adduct, or by reacting 5-ethylidenenorbornene-2 with cyclopentadiene, methylcyclopentadiene or mixtures thereof in accordance with the Diels-Alder reaction to produce a 1:1 of adduct of 5-ethylidenenorbornene-2 and the pentadiene, and hydrogenating carbon-carbon double bonds in the adduct.

2. A high-density liquid fuel according to claim 1 wherein said aliphatic unsaturated hydrocarbon is a compound selected from the group consisting of propylene, 1-butene, 2-butene, isobutylene, 1-pentene, 2-pentene, 2-methyl-1-butene, 3-methyl-1-butene and 2-methyl-2-butene.

3. A high-density liquid fuel according to claim 1 wherein m and n are O and $R^1$ is hydrogen.

4. A high-density liquid fuel according to claim 3 wherein $R^3$ is methyl.

5. A high-density liquid fuel according to claim 4 wherein $R^2$ is methyl.

6. A high-density liquid fuel according to claim 4 in which $R^2$ is ethyl.

7. A high-density liquid fuel according to claim 3 in which $R^2$ is ethyl and $R^3$ is hydrogen.

8. A high-density liquid fuel according to claim 1 in which m and n are O, $R^1$ and $R^2$ are methyl and $R^3$ is hydrogen.

9. A high-density liquid fuel according to claim 1 in which m and n are each 1, $R^1$ is methyl and $R^2$ and $R^3$ are each hydrogen.

10. The high-density liquid fuel according to claim 1 wherein said liquid fuel is usable as a fuel for rockets and jet engines.

* * * * *